US010605126B2

(12) United States Patent
Mariuz et al.

(10) Patent No.: US 10,605,126 B2
(45) Date of Patent: Mar. 31, 2020

(54) SWITCHABLE ROCKER ARM

(71) Applicant: DELPHI TECHNOLOGIES IP LIMITED, St. Michael (BB)

(72) Inventors: Robert M. Mariuz, Pittsford, NY (US); Kevin R. Keegan, Hilton, NY (US); Hermes A. Fernandez, Pittsford, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 15 days.

(21) Appl. No.: 15/955,215

(22) Filed: Apr. 17, 2018

(65) Prior Publication Data

US 2019/0316494 A1 Oct. 17, 2019

(51) Int. Cl.

| | |
|---|---|
| ***F01L 1/22*** | (2006.01) |
| ***F01L 13/00*** | (2006.01) |
| ***F01L 1/18*** | (2006.01) |
| ***F01L 1/047*** | (2006.01) |

(52) U.S. Cl.

CPC ..... *F01L 1/22* (2013.01); *F01L 1/047* (2013.01); *F01L 1/182* (2013.01); *F01L 1/185* (2013.01); *F01L 13/0005* (2013.01); *F01L 2001/186* (2013.01); *F01L 2105/00* (2013.01)

(58) Field of Classification Search

CPC ..... F01L 1/22; F01L 1/047; F01L 13/0005; F01L 1/182; F01L 1/185; F01L 2105/00; F01L 2001/186

USPC ..... 123/90.16, 198 F, 90.41

See application file for complete search history.

(56) References Cited

U.S. PATENT DOCUMENTS

| | | | | |
|---|---|---|---|---|
| 4,768,467 | A | 9/1988 | Yamada et al. | |
| 5,544,626 | A | 8/1996 | Diggs et al. | |
| 5,653,198 | A | 8/1997 | Diggs | |
| 6,314,928 | B1 | 11/2001 | Baraszu et al. | |
| 6,321,705 | B1 | 11/2001 | Fernandez et al. | |
| 6,532,920 | B1 | 3/2003 | Sweetnam et al. | |
| 6,655,331 | B2 * | 12/2003 | Duesmann | F01L 1/18 123/90.16 |
| 7,305,951 | B2 | 12/2007 | Fernandez et al. | |
| 7,614,375 | B2 | 11/2009 | Tawaf et al. | |
| 7,798,113 | B2 | 9/2010 | Fischer et al. | |
| 7,882,814 | B2 | 2/2011 | Spath et al. | |

(Continued)

FOREIGN PATENT DOCUMENTS

| | | |
|---|---|---|
| DE | 10155827 A1 | 5/2003 |
| DE | 4444499 C2 | 6/2003 |

(Continued)

*Primary Examiner* — Patrick Hamo
*Assistant Examiner* — Wesley G Harris
(74) *Attorney, Agent, or Firm* — Joshua M. Haines

(57) ABSTRACT

A rocker arm includes an outer arm defining a lock pin bore which is centered about a lock pin bore axis and an inner arm which selectively pivots relative to the outer arm about a pivot axis which is parallel to the lock pin bore axis. The inner arm includes a protrusion which defines an inner arm stop surface which is planar. A lock pin is disposed within the lock pin bore, the lock pin having a lock pin slot extending thereinto and also having a lock pin stop surface which is planar. The lock pin is displaced within the lock pin bore between a coupled position in which the lock pin stop surface is aligned with the inner arm stop surface and a decoupled position in which the lock pin slot is aligned with the protrusion.

14 Claims, 7 Drawing Sheets

(56) References Cited

U.S. PATENT DOCUMENTS

| | | | | |
|---|---|---|---|---|
| 2001/0023675 | A1 | 9/2001 | Lee et al. | |
| 2005/0247279 | A1 | 11/2005 | Rorig et al. | |
| 2008/0202457 | A1* | 8/2008 | Hirayama | F01L 13/0005 123/90.16 |
| 2010/0300389 | A1* | 12/2010 | Manther | F01L 1/185 123/90.39 |
| 2017/0009610 | A1* | 1/2017 | Ahmed | F01L 1/2405 |

FOREIGN PATENT DOCUMENTS

| | | | | |
|---|---|---|---|---|
| DE | 102015002982 | A1 * | 9/2016 | F01L 1/18 |
| WO | 03042510 | A1 | 5/2003 | |

* cited by examiner

SWITCHABLE ROCKER ARM

STATEMENT REGARDING FEDERALLY SPONSORED RESEARCH OR DEVELOPMENT

This invention was made with government support under Contract No. DE-EE-0007811 awarded by the United States Department of Energy. The government has certain rights in this invention.

TECHNICAL FIELD OF INVENTION

The present invention relates to a rocker arm for valve train of an internal combustion engine; more particularly to a rocker arm with an inner arm which selectively pivots relative to an outer arm, and even more particularly to such a rocker arm with a lock pin which is moved between a coupled position and an uncoupled position.

BACKGROUND OF INVENTION

Variable valve actuation mechanisms for internal combustion engines are well known. It is known to lower the lift, or even to provide no lift at all, of one or more valves of an internal combustion engine, during periods of light engine load. Such valve deactivation or valve lift switching can substantially improve one or more of fuel efficiency, emissions, and engine performance.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm. The inner arm is movably connected to the outer arm. It can be switched by a locking member, from a coupled mode wherein the inner arm is immobilized relative to the outer arm, to a decoupled mode wherein the inner arm can move relative to the outer arm. Typically, the outer arm of the switchable rocker arm is pivotally supported at a first end by the hydraulic lash adjuster. A second end of the outer arm operates against an associated engine valve for opening and closing the valve by the rotation of an associated eccentric cam lobe acting on an inner arm contact surface which may be a roller. The inner arm is connected to the outer arm for pivotal movement about the outer arm's second end with the contact surface of the inner arm disposed between the first and second ends of the outer arm. Typically, the locking member includes a locking pin disposed in a bore in the first end of the outer arm, the locking pin being selectively moved to engage the inner arm to thereby couple the inner arm to the outer arm when engaged, and decouple the inner arm from the outer arm when disengaged.

In a switchable two-step rocker arm, the outer arm typically supports a pair of rollers carried by a shaft. The rollers are positioned to be engaged by associated low-lift eccentric cam lobes that cause the outer arm to pivot about the hydraulic lash adjuster, thereby actuating an associated engine valve to a low-lift. The inner arm, in turn, is positioned to engage an associated high-lift eccentric cam lobe sandwiched between the aforementioned low-lift lobes. The switchable two-step rocker arm is then selectively switched between a coupled and a decoupled mode by the locking member. In the coupled mode, with the inner arm locked to the outer arm, the rotational movement of the central high-lift lobe is transferred from the inner arm, through the outer arm to cause pivotal movement of the rocker arm about the hydraulic lash adjuster, which in turn opens the associated valve to a high-lift. In the decoupled mode, the inner arm is no longer locked to the outer arm and is permitted to move relative to the outer arm against a lost motion spring that biases the inner arm away from the outer arm. In turn, the rollers of the outer arm engage their associated low-lift lobes. The rotational movement of the low-lift lobes is transferred directly through the outer arm, and the associated valve is reciprocated by the outer arm to a low-lift. It should be noted that high-lift and low-lift as used herein designates that high-lift encompasses one or both of greater magnitude of valve lift and greater duration of the valve being opened compared to low-lift.

A switchable deactivation rocker arm typically includes an outer arm and an inner arm. The inner arm supports a roller carried by a shaft. The roller is engaged by an eccentric lifting cam lobe for actuating an associated engine valve. Like the switchable two-step rocker arm, the switchable deactivation rocker arm is selectively switched between a coupled and a decoupled mode by a movable locking member. In the coupled mode, the inner arm of the switchable deactivation rocker arm is locked to the outer arm and the rotational movement of the associated lifting cam lobe is transferred from the inner arm, through the outer arm to cause pivotal movement of the rocker arm about the hydraulic lash adjuster which in turn opens the associated valve to a prescribed lift. In the decoupled mode, the inner arm becomes unlocked from the outer arm and is permitted to pivot relative to the outer arm against a lost motion spring. In the decoupled mode, the rotational movement of the lifting cam lobe is absorbed by the inner arm in lost motion and is not transferred to the outer arm. Thus, the associated valve remains closed when the switchable deactivation rocker arm is in its decoupled mode.

Examples of switchable rocker arms are shown, for example, in U.S. Pat. Nos. 5,544,626; 5,653,198; 6,314,928; 6,532,920; 7,614,375; 7,798,113; and 7,882,814 and United States Patent Application Publication Numbers US 2005/0247279 A1 and US 2001/0023675 A1. However, development in the art of switchable rocker arms is continually sought to improve packaging and efficiency.

SUMMARY OF THE INVENTION

Briefly described, a rocker arm is provided for transmitting rotational motion from a camshaft to opening and closing motion of a combustion valve in an internal combustion engine. The rocker arm includes an outer arm defining a lock pin bore which is centered about, and extends along, a lock pin bore axis; an inner arm which selectively pivots relative to the outer arm about a pivot axis which is parallel to the lock pin bore axis, the inner arm including a protrusion which defines an inner arm stop surface which is planar; a lost motion spring which biases the inner arm to pivot relative to the outer arm in a first rotational direction;

and a lock pin disposed within the lock pin bore, the lock pin having a lock pin slot extending thereinto and also having a lock pin stop surface which is planar. The lock pin is displaced within the lock pin bore between 1) a coupled position in which the lock pin stop surface is aligned with the inner arm stop surface, thereby preventing the inner arm from pivoting relative to the outer arm past a predetermined position of the inner arm relative to the outer arm in a second rotational direction in which the inner arm stop surface contacts the lock pin stop surface, the second rotational direction being opposite of the first rotational direction and 2) a decoupled position in which the lock pin slot is aligned with the protrusion such that the inner arm is allowed to pivot relative to the outer arm past the predetermined position in the second rotational direction such that the protrusion extends into the lock pin slot when the inner arm is pivoted past the predetermined position.

BRIEF DESCRIPTION OF DRAWINGS

This invention will be further described with reference to the accompanying drawings in which.

DETAILED DESCRIPTION OF INVENTION

Figure 1:
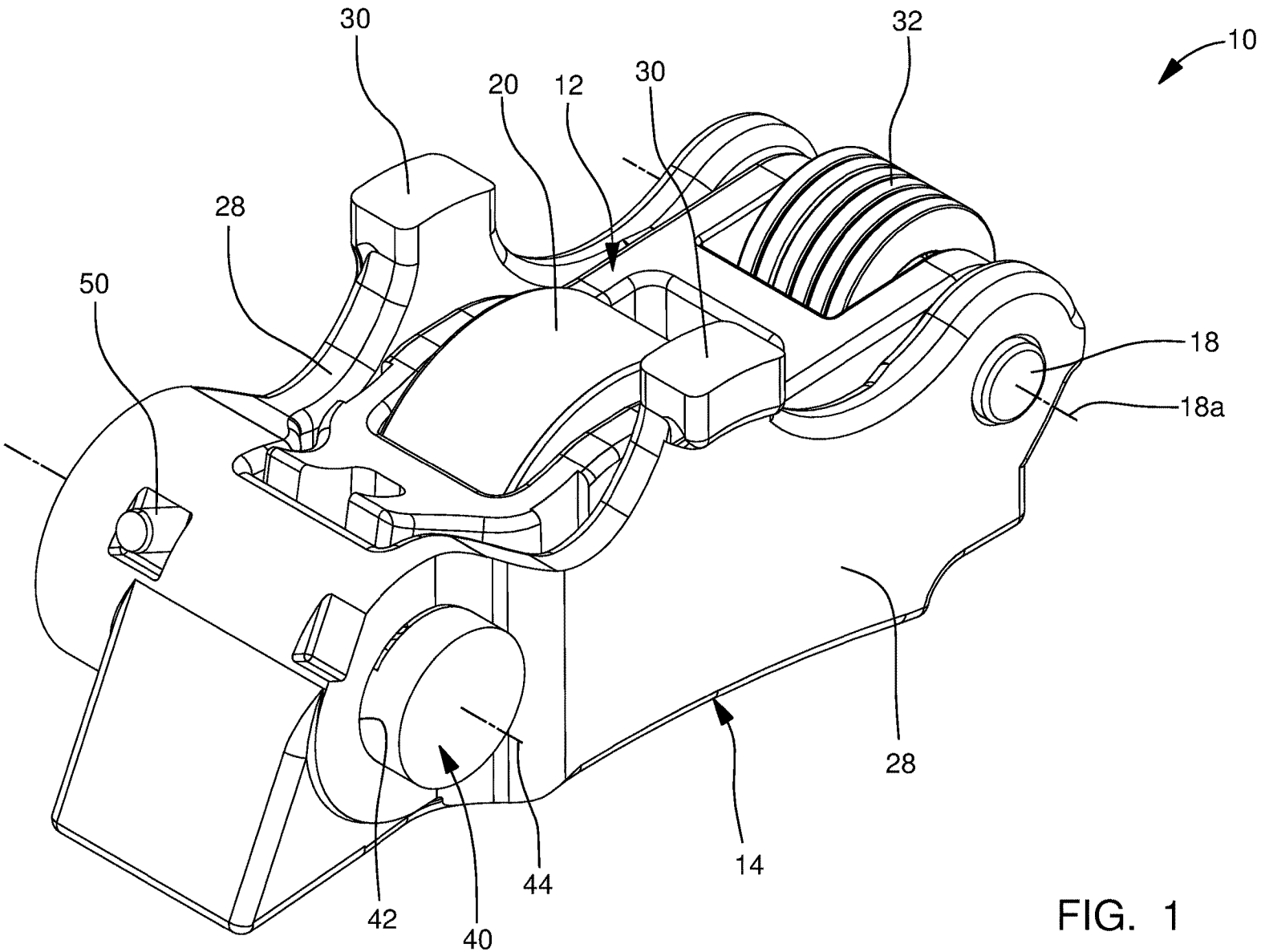
FIG. 1 is an isometric view of a rocker arm in accordance with the present invention.
Figure 2:
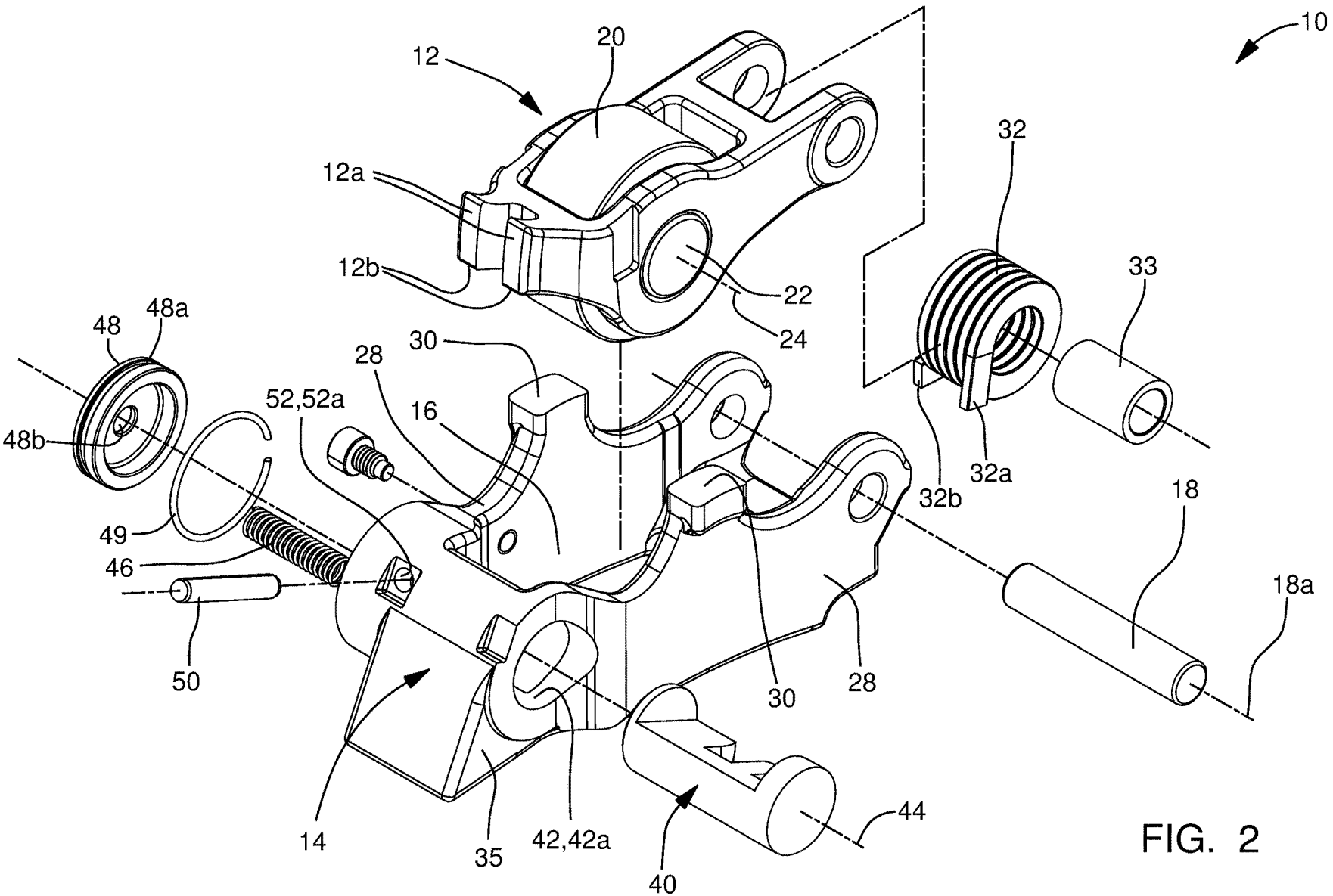
FIG. 2 is an exploded isometric view of the rocker arm of FIG. 1.

Referring initially to FIGS. 1-4, a rocker arm 10 in accordance with the invention is illustrated where rocker arm 10 is either a two-step rocker arm or a deactivation rocker arm, which may generically be referred to as a switchable rocker arm. Rocker arm 10 is included in valve train (not shown) of an internal combustion engine (not shown) in order to translate rotational motion of a camshaft (not shown) to reciprocating motion of a combustion valve (not shown). Rocker arm 10 includes an inner arm 12 that is pivotably disposed in a central opening 16 of an outer arm 14. Inner arm 12 is supported by, and selectively pivots within, outer arm 14 about a pivot shaft 18 which is supported at opposite ends thereof by outer arm 14 which is centered about, and extends along, a pivot axis 18*a*. Inner arm 12 includes a follower illustrated as a roller 20 carried by a roller shaft 22 that is supported by inner arm 12 such that roller 20 and roller shaft 22 are centered about a roller shaft axis 24. Roller 20 is configured to follow a lobe of the camshaft, for example a high-lift lobe, to impart lifting motion on a respective combustion valve. A bearing 26 may rotatably support roller 20 on roller shaft 22 for following a cam lobe of a lifting cam of an engine camshaft (not shown). Bearing 26 may be, for example, a plurality of rollers or needle bearings. Roller shaft 22 is fixed to inner arm 12, by way of non-limiting example only by staking each end of roller shaft 22 in order to cause each end of roller shaft 22 to be increased in diameter to prevent removal from inner arm 12. Outer arm 14 includes two walls 28 positioned parallel to each other such that walls 28 are perpendicular to roller shaft axis 24 and such that walls 28 are spaced apart from each other to define central opening 16 therebetween. Outer arm 14 also includes followers 30 such that one follower 30 is fixed to each wall 28. As shown, followers 30 may be sliding surfaces, but may alternatively be rollers. Followers 30 are configured to follow respective lobes of the camshaft, for example low-lift lobes which impart lifting motion on a respective combustion valve or null lobes which do not impart lifting motion on a respective combustion valve. A lost motion spring 32 acts between inner arm 12 and outer arm 14 to pivot inner arm 12 away from outer arm 14 in a first rotational direction (clockwise as viewed in FIGS. 3 and 4). More particularly, lost motion spring 32 may be a coiled torsion spring which circumferentially surrounds a central portion of pivot shaft 18 with a bushing 33 disposed radially between pivot shaft 18 and lost motion spring 32 such that a spring first end 32*a* is grounded to inner arm 12 and such that a spring second end 32*b* is grounded to outer arm 14. A socket 34 for pivotably mounting rocker arm 10 on a lash adjuster (not shown) is included in an outer arm body 35 at a first end 14*a* of outer arm 14 where outer arm body 35 connects walls 28 at first end 14*a* while a pad 36 for actuating a valve stem (not shown) is included at a second end 14*b* of outer arm 14 such extends between each walls 28, thereby connecting walls 28 at second end 14*b*. A lock pin 40 disposed within outer arm 14 near first end 14*a* thereof selectively permits inner arm 12 to pivot relative to outer arm 14 about pivot shaft 18 and also selectively prevents inner arm 12 from pivoting relative to outer arm 14 about pivot shaft 18 as will be described in greater detail later. While the follower of inner arm 12 has been illustrated as roller 20, it should be understood that the follower of inner arm 12 may alternatively be a sliding surface as shown in U.S. Pat. No. 7,305,951 to Fernandez et al. Similarly, while followers 30 of outer arm 14 have been illustrated as sliding surfaces, it should be understood that followers 30 may alternatively be rollers as shown in U.S. Pat. No. 7,305,951. It should also be understood that the followers of inner arm 12 and outer arm 14 may all be rollers or may all be sliding surfaces. Additionally, while lost motion spring 32 has been illustrated as a coiled torsion spring which circumferentially surrounds pivot shaft 18, it should be understood that lost motion spring 32 may take numerous other forms, which may be, by way of non-limiting example only, a coiled torsion spring which does not circumferentially surround pivot shaft 18 or a compression spring which acts between opposing surfaces of inner arm 12 and outer arm 14.

Figure 3:
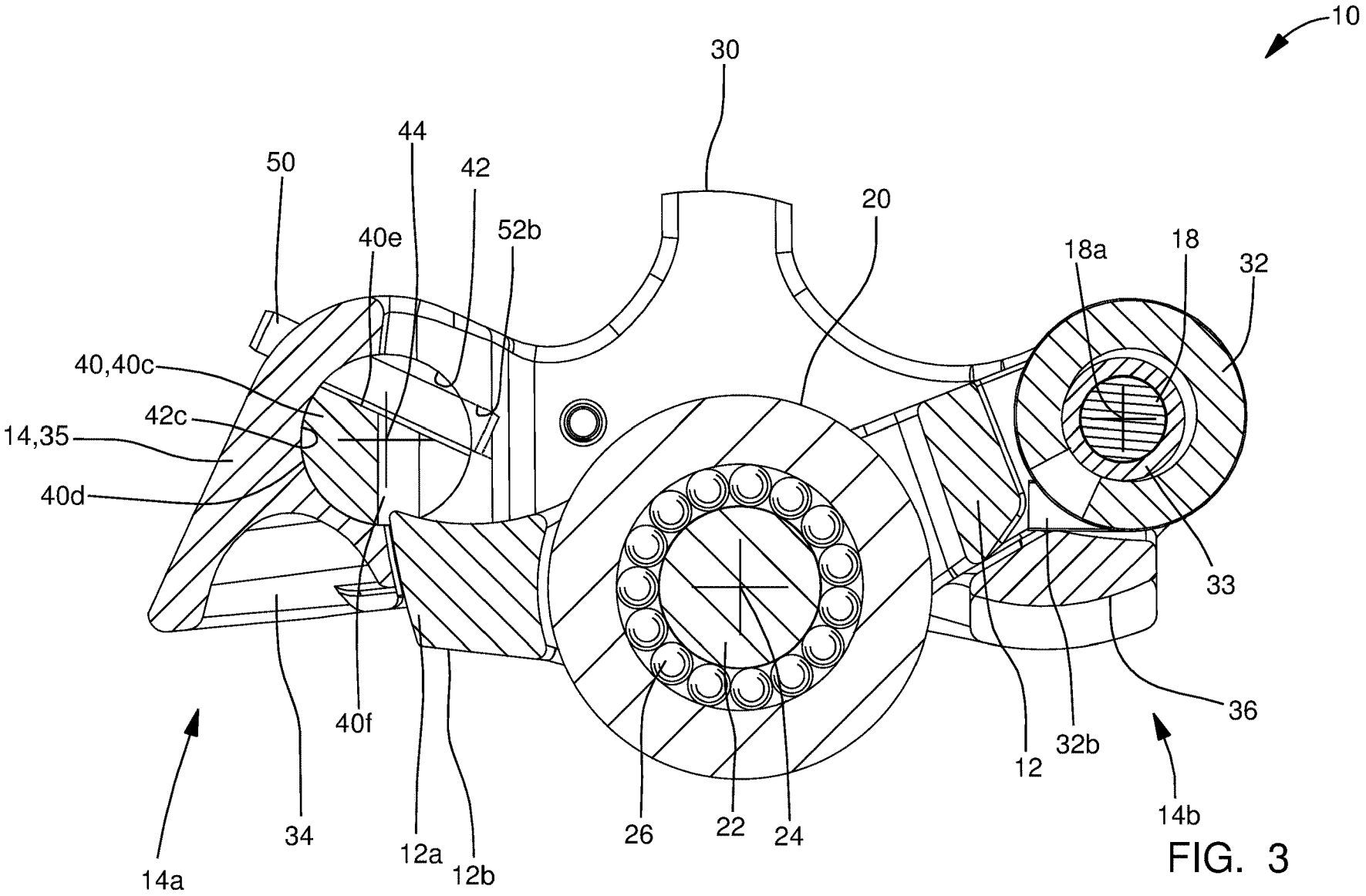
FIG. 3 is a cross-sectional view of the rocker arm of FIG. 1, taken through a plane that is perpendicular to an axis about which an inner arm of the rocker arm pivots relative to an outer arm of the rocker arm, shown in a decoupled state.
Figure 4:
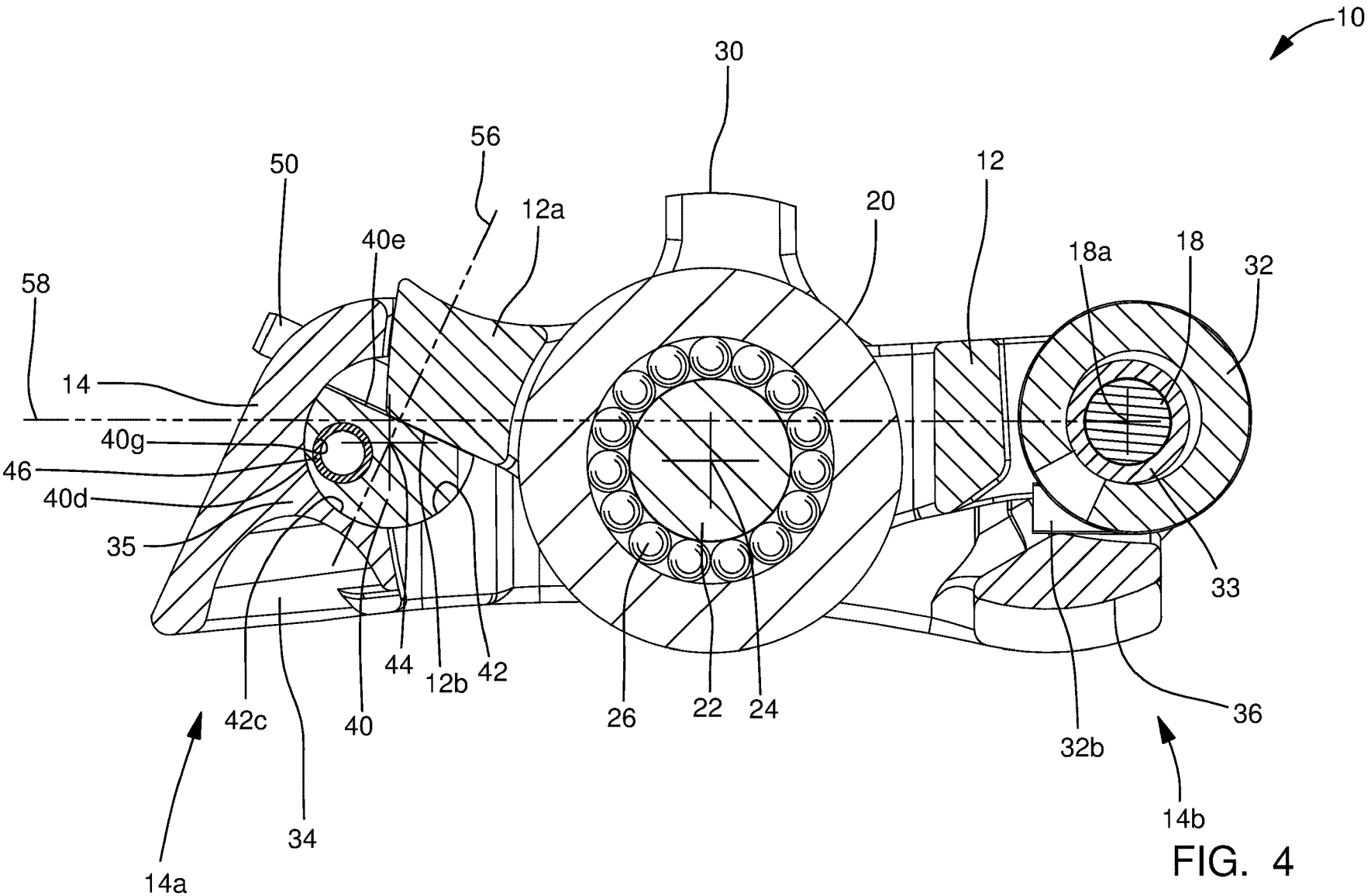
FIG. 4 is the cross-sectional view of FIG. 3, now showing the rocker arm in a coupled state.

Rocker arm 10 is selectively switched between a coupled state and a decoupled state by lock pin 40. In the coupled state as shown in FIG. 4, inner arm 12 is prevented from pivoting relative to outer arm 14 past a predetermined position of inner arm 12 relative to outer arm 14 in a second rotational direction, shown as counterclockwise in FIG. 4, which is opposite from the first rotational direction. In this way, in the coupled state, inner arm 12, and therefore roller shaft 22, is coupled to outer arm 14, and rotation of the lifting cam is transferred from roller 20 through roller shaft 22 to pivotal movement of outer arm 14 about the lash adjuster which, in turn, reciprocates the associated valve. In the decoupled state as shown in FIG. 3, inner arm 12 is able to pivot relative to outer arm 14 past the predetermined position in the second rotational direction, i.e. counterclockwise as viewed in FIG. 3. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12 together with roller 20 and roller shaft 22 reciprocate within central opening 16, thereby compressing and uncompressing lost motion spring 32 in a cyclic manner such that lost motion spring 32 biases inner arm 12 to pivot relative to outer arm 14 in the first rotational direction, shown as clockwise in FIG. 3.

Lock pin 40 will now be described in greater detail with continued reference to FIGS. 1-4, and now with additional reference to FIGS. 5-7. Lock pin 40 is received within a lock pin bore 42 defined by outer arm 14 such that lock pin bore 42 is centered about, and extends along, a lock pin bore axis 44 which is parallel to, and laterally offset from, pivot axis 18*a*. Lock pin bore 42 generally includes three portions, namely, a lock pin bore first portion 42*a* which extends through one wall 28 of outer arm 14, a lock pin bore second portion 42*b* which extends into the other wall 28 of outer arm 14 from central opening 16, and a lock pin bore third portion 42*c* which is axially between lock pin bore first portion 42*a* and lock pin bore second portion 42*b* and extends through outer arm body 35. Lock pin bore first portion 42*a* and lock pin bore second portion 42*b* are each cylindrical surfaces which completely surround lock pin bore axis 44. In contrast, lock pin bore third portion 42*c* is open to central opening 16 in a direction radially outward from lock pin bore axis 44, and consequently, lock pin bore third portion 42*c* is a sector of a cylindrical surface such that lock pin bore third portion 42*c* has a radius that is equal to the radius of lock pin bore first portion 42*a* and lock pin bore second portion 42*b*. A lock pin bore counterbore 42*d* extends from lock pin bore second portion 42*b* to the outer surface of wall 28 that is opposed to central opening 16.

Lock pin 40 includes three portions, namely, a lock pin first portion 40*a* at one axial end thereof, a lock pin second portion 40*b* at the other axial end thereof, and a lock pin third portion 40*c* which joins lock pin first portion 40*a* and lock pin second portion 40*b*. Lock pin first portion 40*a* and lock pin second portion 40*b* are each cylinders having a common diameter centered about lock pin bore axis 44 such that lock pin first portion 40*a* is sized to interface with lock pin bore first portion 42*a* in a close-sliding interface such that lock pin first portion 40*a* is able to move freely within lock pin bore first portion 42*a* along lock pin bore axis 44 while substantially preventing movement of lock pin first portion 40*a* within lock pin bore first portion 42*a* radially relative to lock pin bore axis 44. Similarly, lock pin second portion 40*b* is sized to interface with lock pin bore second portion 42*b* in a close-sliding interface such that lock pin second portion 40*b* is able to move freely within lock pin bore second portion 42*b* along lock pin bore axis 44 while substantially preventing movement of lock pin second portion 40*b* within lock pin bore second portion 42*b* radially relative to lock pin bore axis 44. Lock pin third portion 40*c* includes a lock pin surface 40*d* which is a sector of a cylinder having a radius R40*d* which is centered about lock pin bore axis 44 and which is equal in magnitude to the radius R40*a* of lock pin first portion 40*a* centered about lock pin bore axis 44 and also equal in magnitude to the radius R40*b* of lock pin second portion 40*b* centered about lock pin bore axis 44. Lock pin third portion 40*c* also includes a lock pin stop surface 40*e* which is planar and which extends axially from lock pin first portion 40*a* to lock pin second portion 40*b* such that the intersection of lock pin stop surface 40*e* and lock pin first portion 40*a* is a chord of a circle, thereby defining a circular segment on lock pin first portion 40*a* and such that the intersection of lock pin stop surface 40*e* and lock pin second portion 40*b* is a chord of a circle, thereby defining a circular segment on lock pin second portion 40*b*. Lock pin third portion 40*c* also includes two lock pin slots 40*f* which are parallel to each other and extend from lock pin surface 40*d* inward for a distance that is greater than the radius of lock pin first portion 40*a* and lock pin second portion 40*b* such that lock pin slots 40*f* face toward inner arm 12. Furthermore, lock pin slots 40*f* intersect with lock pin surface 40*d*. While two lock pin slots 40*f* have been illustrated herein, it should be understood that a lesser number or a greater number of lock pin slots 40*f* may be provided. A return spring bore 40*g* (shown only in FIG. 4) extends axially, i.e. in a direction parallel to lock pin bore axis 44, into lock pin 40 from lock pin second portion 40*b* such that return spring bore 40*g* is laterally offset from lock pin bore axis 44. Alternatively, but not shown, return spring bore 40*g* may be centered about lock pin bore axis 44. A return spring 46, illustrated as a coil compression spring, is received within return spring bore 40*g* as will be described in greater detail later.

Figure 5:
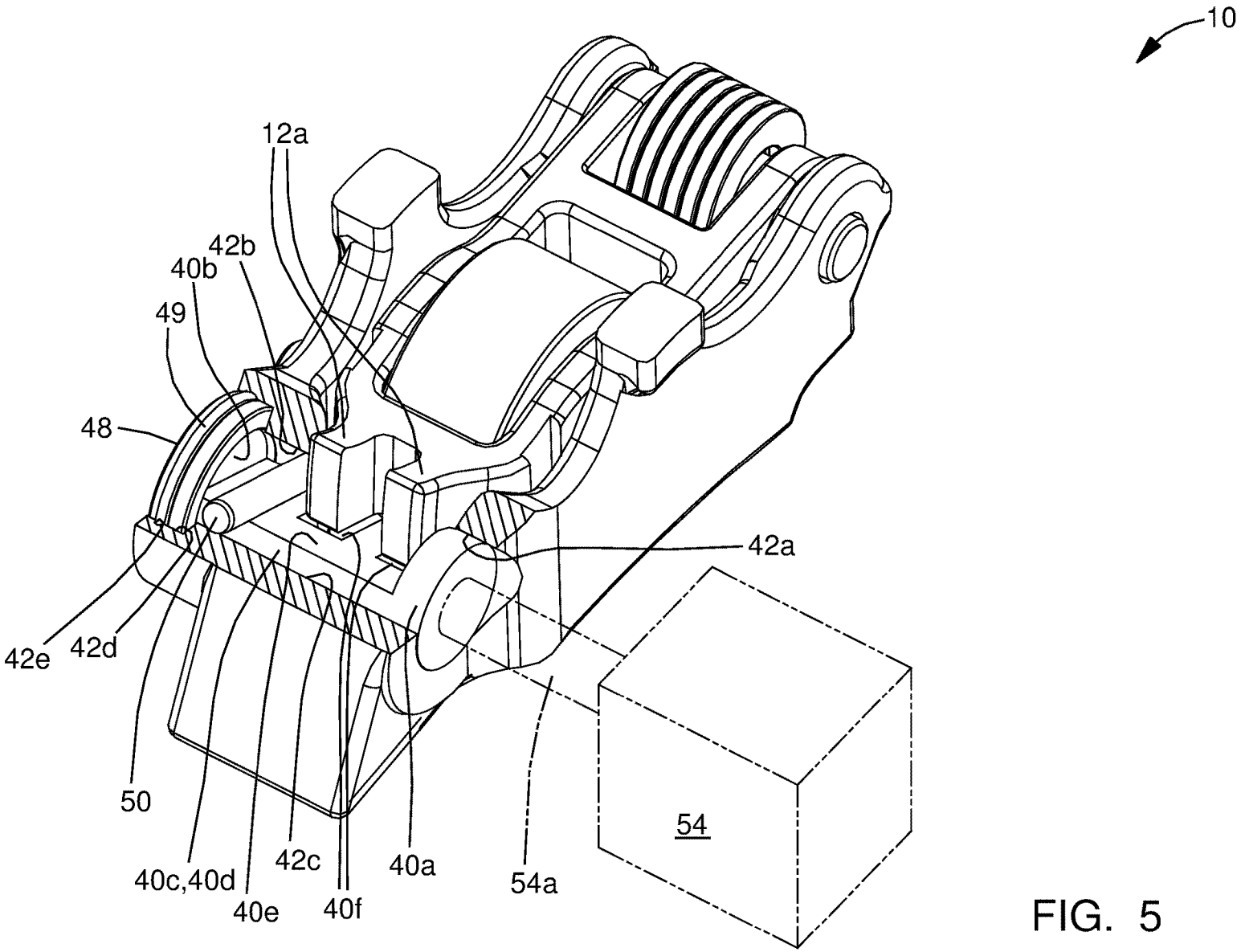
FIG. 5 is the isometric view of FIG. 1 with an outer arm partially sectioned showing a lock pin in a decoupled position.
Figure 6:
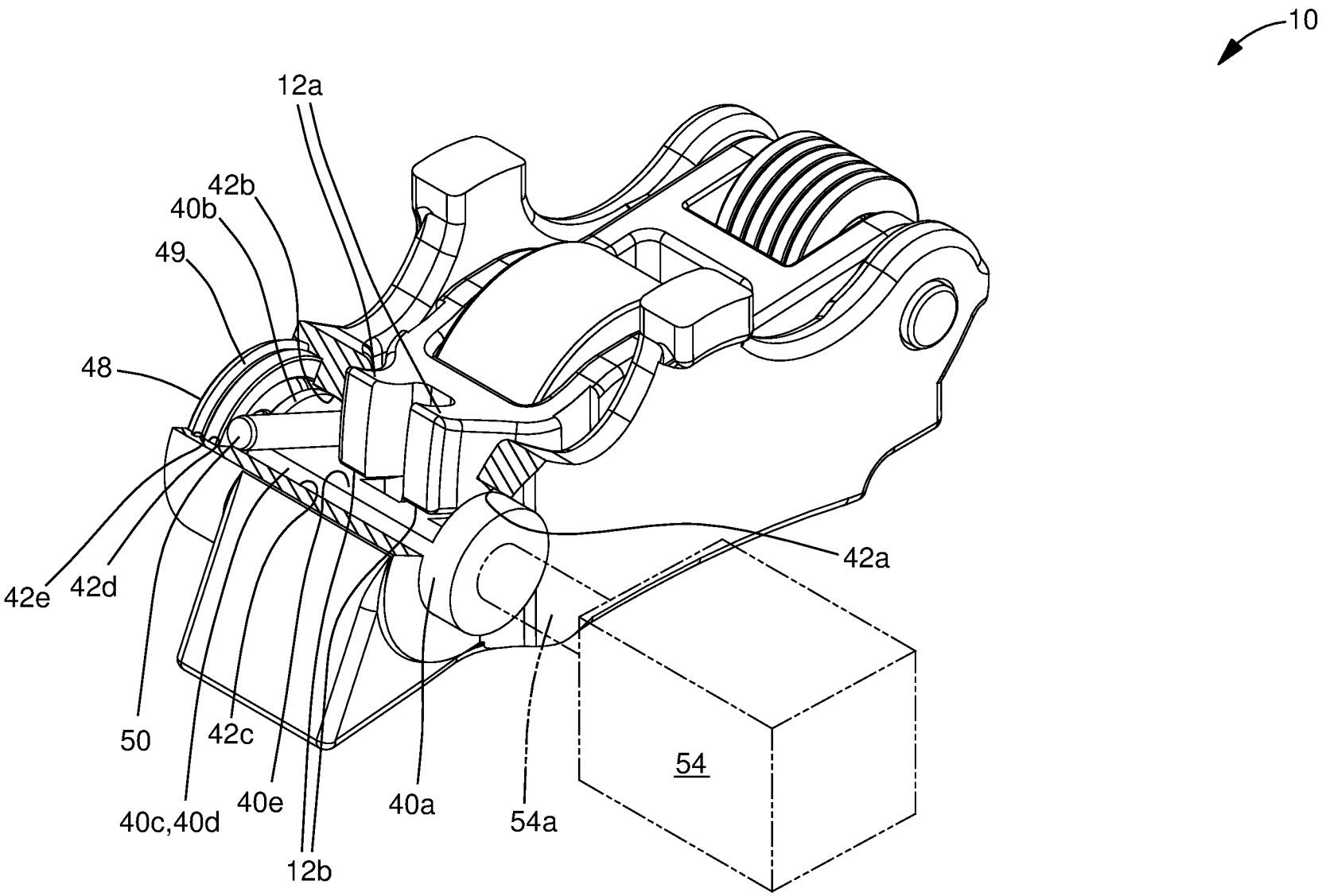
FIG. 6 is the view of FIG. 5 now shown with the lock pin in a coupled position.
Figure 7:
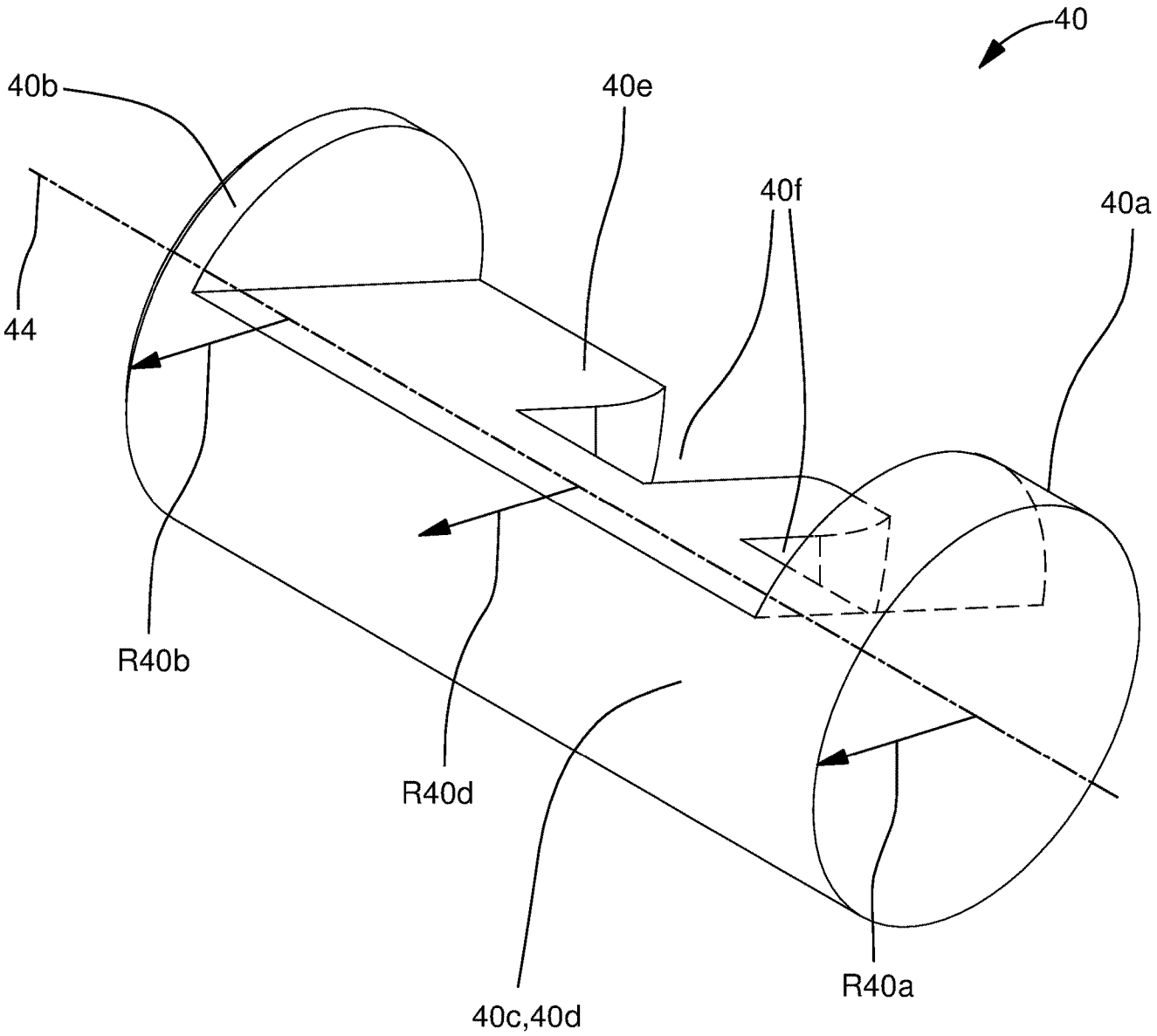
FIG. 7 is an enlarged isometric view of the lock pin.

A retention plug 48 is disposed and fixed within lock pin bore counterbore 42*d* in order to limit travel of lock pin 40 in a first axial direction, i.e. toward the upper left as viewed in FIGS. 5 and 6. Retention plug 48 also serves as a surface upon which return spring 46 acts in order to bias lock pin 40 in a second axial direction i.e. toward the lower right as viewed in FIG. 5. Retention plug 48 may be retained within lock pin bore counterbore 42*d* with retainer ring 49 which is received within a complementary retention plug groove 48*a* which extends radially inward from the outer periphery of retention plug 48 and within a complementary lock pin bore groove 42*e* which extends radially outward from lock pin bore counterbore 42*d*. In addition to, or in the alternative, retention plug 48 may be retained within lock pin bore counterbore 42*d* using an interference fit, adhesive, welding, staking, and the like. A retention plug aperture 48*b* may extend axially through retention plug 48 as shown in order to prevent an accumulation of oil (used to lubricate rocker arm 10 and other elements of the internal combustion engine) in the space between lock pin second portion 40*b* and retention plug 48 because an accumulation of oil in this space may impact movement of lock pin 40 within lock pin bore 42. In an alternative arrangement that is not shown, retention plug 48, retainer ring 49, and related features of lock pin bore 42 may be omitted and lock pin bore second portion 42*b* may be a blind bore where the bottom of the blind bore serves the same function as retention plug 48.

A retention pin 50 is provided in order to limit travel of lock pin 40 in the second axial direction, i.e. toward the lower right as viewed in FIG. 6 and to limit rotation of lock pin 40 about lock pin bore axis 44 within lock pin bore 42. Retention pin 50 may also prevent lock pin 40 from being removed from lock pin bore 42 after manufacture of rocker arm 10, but before rocker arm 10 is installed in the internal combustion engine. Retention pin 50 is received within a retention pin bore 52 which extends into outer arm 14 in a direction that is normal to lock pin bore axis 44 and which intersects lock pin bore 42, and more specifically intersects with lock pin bore second portion 42*b*. In this way, lock pin bore 42 interrupts retention pin bore 52 and separates retention pin bore 52 (shown only in FIG. 3) into a retention pin bore first portion 52*a* and a retention pin bore second portion 52*b* such that a portion of retention pin 50 is supported circumferentially within retention pin bore first portion 52*a* and such that another portion of retention pin 50 is supported circumferentially within retention pin bore second portion 52*b*, and as a result, an intermediate portion of retention pin 50 is located within lock pin bore 42 such that lock pin second portion 40*b* is captured axially, i.e. in a direction parallel to lock pin bore axis 44, between retention pin 50 and retention plug 48. Furthermore, the intermediate portion of retention pin 50 is located between lock pin first portion 40*a* and lock pin second portion 40*b*. As may be best seen in FIGS. 3 and 4, the edge of retention pin 50 that faces toward lock pin stop surface 40*e* is in close proximity thereto, but is laterally offset slightly in order to allow slight rotation of lock pin 40 within lock pin bore 42, thereby ensuring that lock pin 40 is able to rotate sufficiently far to allow a face contact between inner arm stop surfaces 12*b* of inner arm 12 and lock pin stop surface 40*e* of lock pin 40. Retention pin 50 may be a dowel pin as shown, or may alternatively be a roll pin. Retention pin 50 may be retained by interference fit with retention pin bore 52 or may alternatively, or in addition to, be retained by welding, staking, adhesive bonding, and the like. In an alternative arrangement that is not shown, retention pin bore second portion 52*b* may be omitted and retention pin 50 is cantilevered such that retention pin 50 is supported only within retention pin bore first portion 52*a*.

Inner arm 12 includes inner arm protrusions 12*a* which are sized and spaced to fit within lock pin slots 40*f* when lock pin 40 is positioned within lock pin bore 42 in a decoupled position as shown in FIGS. 3 and 5. Furthermore, inner arm protrusions 12*a* define inner arm stop surfaces 12*b* which are planar and which mate with lock pin stop surface 40*e* when lock pin 40 is positioned within lock pin bore 42 in a coupled position as shown in FIGS. 4 and 6. The decoupled position and coupled position of lock pin 40 will be described in greater detail later. While inner arm 12 is illustrated herein as having two inner arm protrusions 12*a*, it should be understood that two inner arm protrusions 12*a* have been selected to be complementary to the quantity of lock pin slots 40*f*. Consequently, the quantity of inner arm protrusions 12*a* may be less in quantity or more in quantity depending on how many lock pin slots 40*f* are provided in lock pin 40.

In order to change the position of lock pin 40 within lock pin bore 42, actuation means may be provided, illustrated schematically in phantom lines herein as solenoid 54 (shown only in FIGS. 5 and 6). Solenoid 54 includes an actuation rod 54*a* which is axially displaceable by application of electricity to a coil (not shown) of solenoid 54 which creates a magnetic attraction between elements (not shown) within solenoid 54 which causes actuation rod 54*a* to move in the first axial direction, i.e. toward the upper left as viewed and shown in FIG. 5, until lock pin 40 abuts retention plug 48 in order to achieve the decoupled position which aligns lock pin slots 40*f* with inner arm protrusions 12*a*, thereby allowing inner arm 12 to pivot relative to outer arm 14 in the second rotational direction (counterclockwise as viewed in FIG. 3) past the predetermined position such that inner arm protrusions 12*a* extend into lock pin slots 40*f*. It should be noted that FIG. 4 shows inner arm 12 in the predetermined position and FIG. 3 shows inner arm 12 pivoted past the predetermined position in the second rotational direction. As can be seen in FIG. 5, when lock pin 40 is the decoupled position, lock pin second portion 40*b* is located within retention plug 48 such that lock pin second portion 40*b* is circumferentially surrounded by retention plug 48 and such that lock pin second portion 40*b* is entirely removed from lock pin bore second portion 42*b*. Conversely, when application of electricity to the coil of solenoid 54 is stopped, the magnetic attraction of the elements within solenoid 54 ceases, thereby eliminating the force of actuation rod 54*a* on lock pin 40 in the first axial direction. With the force of actuation rod 54*a* on lock pin 40 eliminated, return spring 46 urges lock pin 40 and actuation rod 54*a* in the second axial direction, i.e. toward the lower left as viewed and shown in FIG. 6, until lock pin second portion 40*b* abuts retention pin 50 in order to achieve the coupled position which aligns lock pin stop surface 40*e* with inner arm protrusions 12*a* and consequently, lock pin stop surface 40*e* is aligned with inner arm stop surfaces 12*b* which prevents inner arm 12 from pivoting relative to outer arm 14 past the predetermined position of inner arm 12 relative to outer arm 14 in the second rotational direction. It should be noted that FIG. 4 shows inner arm 12 in the predetermined position. Solenoids such as solenoid 54 are well known to those of ordinary skill in the art, and consequently, solenoid 54 will not be described further herein. While the actuation means has been illustrated as solenoid 54, it should be understood that the actuation means may take the form of any one of a number of alternatives, which may be, by way of non-limiting example only, hydraulic actuation which includes a hydraulic chamber in which pressurized fluid, such as engine oil, is selectively provided to urge lock pin 40 in the first axial direction.

When inner arm 12 is in the predetermined position as shown in FIG. 4, a first imaginary line 56 extending perpendicular through lock pin bore axis 44 and perpendicular to inner arm stop surface 12*b* extends through inner arm stop surface 12*b*. In this way, inner arm stop surfaces 12*b* extend over lock pin bore axis 44, thereby preventing rotation of lock pin 40 by inner arm 12 since force from inner arm 12 is applied to lock pin stop surface 40*e* on each side of lock pin bore axis 44. Furthermore, a second imaginary line 58 is oblique relative to first imaginary line 56 when inner arm 12 is in the predetermined position such that second imaginary line 58 extends perpendicular through pivot axis 18*a* and through an intersection of first imaginary line 56 and inner arm stop surface 12*b*. In this way, the force from inner arm 12 is transferred into outer arm body 35 at lock pin bore third portion 42*c* such that forces from inner arm 12 pass through imaginary line 56 which places lock pin 40 in compression against lock pin bore third portion 42*c* where FIG. 4 shows that imaginary line 56 consequently passes through lock pin bore third portion 42.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm defining a lock pin bore which is centered about, and extends along, a lock pin bore axis;

an inner arm which selectively pivots relative to said outer arm about a pivot axis which is parallel to said lock pin bore axis, said inner arm including a protrusion which defines an inner arm stop surface which is planar;

a lost motion spring which biases said inner arm to pivot relative to said outer arm in a first rotational direction; and a lock pin disposed within said lock pin bore, said lock pin having a lock pin slot extending thereinto and also having a lock pin stop surface which is planar, wherein said lock pin is displaced within said lock pin bore between 1) a coupled position in which said lock pin stop surface is aligned with said inner arm stop surface, thereby preventing said inner arm from pivoting relative to said outer arm past a predetermined position of said inner arm relative to said outer arm in a second rotational direction in which said inner arm stop surface contacts said lock pin stop surface, said second rotational direction being opposite of said first rotational direction and 2) a decoupled position in which said lock pin slot is aligned with said protrusion such that said inner arm is allowed to pivot relative to said outer arm past said predetermined position in said second rotational direction such that said protrusion extends into said lock pin slot when said inner arm is pivoted past said predetermined position;

wherein said lock pin comprises:

a lock pin first portion which is cylindrical such that said lock pin first portion is centered about, and extends along, said lock pin bore axis;

a lock pin second portion which is cylindrical such that said lock pin first portion is centered about, and extends along, said lock pin bore axis; and a lock pin third portion which includes said lock pin stop surface and said lock pin slot such that said lock pin third portion connects said lock pin first portion and said lock pin second portion.

2. A rocker arm as in claim 1, wherein said lock pin stop surface extends from said lock pin first portion to said lock pin second portion.

3. A rocker arm as in claim 2, wherein an intersection of said lock pin stop surface and said lock pin first portion is a chord of a circle, thereby defining a circular segment on said lock pin first portion.

4. A rocker arm as in claim 3, wherein an intersection of said lock pin stop surface and said lock pin second portion is a chord of a circle, thereby defining a circular segment on said lock pin second portion.

5. A rocker arm as in claim 1, wherein said lock pin third portion includes a lock pin surface which is a sector of a cylinder.

6. A rocker arm as in claim 5, wherein said lock pin surface has a radius that is equal in magnitude to a radius of said lock pin first portion and is also equal in magnitude to a radius of said lock pin second portion.

7. A rocker arm as in claim 6, wherein said radius of said lock pin surface, said radius of said lock pin first portion, and said radius of said lock pin second portion are centered about said lock pin bore axis.

8. A rocker arm as in claim 1, wherein said rocker arm further comprises a retention pin which extends into said lock pin bore in a direction which is normal to said lock pin bore axis such that said retention pin is located between said lock pin first portion and said lock pin second portion.

9. A rocker arm as in claim 8, wherein said lock pin second portion abuts said retention pin when said lock pin is in said coupled position.

10. A rocker arm as in claim 8, wherein said rocker arm further comprises a retention plug fixed within said lock pin bore such that said lock pin second portion is captured axially between said retention plug and said retention pin.

11. A rocker arm as in claim 10, wherein said lock pin second portion is circumferentially surrounded by said retention plug when said lock pin is in said decoupled position.

12. A rocker arm as in claim 10, wherein said lock pin second portion abuts said retention plug when said lock pin is in said decoupled position.

13. A rocker arm as in claim 10, wherein said lock pin includes a return spring bore which is parallel to, and laterally offset from said lock pin bore axis and said rocker arm further comprises a return spring within said return spring bore which urges said lock pin toward said decoupled position.

14. A rocker arm as in claim 10 wherein said lock pin bore includes a lock pin bore counterbore within which said retention plug is fixed.

* * * * *